US005398764A

United States Patent [19]

Collins

[11] Patent Number: 5,398,764

[45] Date of Patent: Mar. 21, 1995

[54] WELL TOOL SYSTEM AND METHOD FOR USE IN A WELL CONDUIT

[75] Inventor: Leo G. Collins, Lewisville, Tex.

[73] Assignee: Halliburton Company, Houston, Tex.

[21] Appl. No.: 89,185

[22] Filed: Jul. 12, 1993

[51] Int. Cl.[6] ..... F21B 23/02

[52] U.S. Cl. ..... 166/382; 166/212; 166/217

[58] Field of Search ..... 166/212, 214, 217, 382

[56] References Cited

U.S. PATENT DOCUMENTS

| | | | |
|---|---|---|---|
| 4,265,306 | 5/1981 | Stout | 166/214 X |
| 4,378,839 | 4/1983 | Fisher, Jr. | 166/217 |
| 4,418,750 | 12/1983 | Paschal, Jr. | 166/214 |
| 4,545,434 | 10/1985 | Higgins | 166/217 |
| 4,745,974 | 5/1988 | Higgins | 166/217 |
| 4,962,813 | 10/1990 | Welch | 166/217 |
| 4,997,038 | 3/1991 | Welch | 166/214 |
| 5,119,875 | 6/1992 | Richard | 166/212 |

*Primary Examiner*—Ramon S. Britts
*Assistant Examiner*—Frank S. Tsay
*Attorney, Agent, or Firm*—Tracy W. Druce; Drude Faulconer

[57] ABSTRACT

A well tool system and a method utilizing said system e.g. pressuring a well conduit to determine whether the conduit has leaks. The system allows a plurality of no go type landing nipples to be used in a conduit without prohibitively restricting the flow therethrough. With the tool of the present system, the landing surface in each nipple is substantially smaller than in prior no go nipples since the landing surface does not support the tool during the well operation. Pressure-actuated, load-bearing keys are expanded into contact with the nipple once the tool is landed which, in turn, bear substantially all of the downward force on the tool during the well operation. The tool can easily be removed by reducing the upstream pressure and lifting the tool upward in the conduit.

23 Claims, 3 Drawing Sheets

WELL TOOL SYSTEM AND METHOD FOR USE IN A WELL CONDUIT

DESCRIPTION

1. Technical Field

The present invention relates to well tools and in one of its aspects relates to a well tool and a method in which it is used in a well conduit system (e.g. testing a well conduit for leaks) wherein the well tool is landed on a relatively small landing surface of a no-go nipple within the well conduit to block downward flow in the conduit and at least one load-bearing key is expanded into contact with the nipple profile wherein substantially all of the downward forces on the tool are transferred through the expanded key to the nipple without any substantial load being applied to the relatively small landing surface in the nipple.

2. Background

It is well known to use landing nipples to position various well tools at different downhole locations within a string of well conduit (e.g. tubing, casing, etc.) after the conduit has been lowered into a well. One type of landing nipple commonly used for such purposes is referred to as a "no-go" nipple. A typical no-go nipple has an annular landing surface (i.e. a shoulder) which protrudes radially into the conduit and is sized to engage, stop, and support a correspondingly-sized well tool as the tool passes downward in the conduit.

In a typical no-go landing nipple, the area of this landing surface must be relatively large since it provides substantially all of the support required in landing, setting, and maintaining the well tool in the nipple during any subsequent well operation involving the tool. For example, in pressuring or testing a conduit in a well for leaks, a removable well tool (e.g. plug or valve) is lowered onto the landing surface of a no-go nipple to block downward flow in the conduit at that point. Pressure is increased in the conduit above the tool to a relatively high test pressure after which the well (i.e. conduit) is closed-in and the test pressure is monitored to detect any decrease in pressure which, in turn, indicates a leak in the conduit string above the well tool.

It is well established that if the area of the landing surface of a no-go nipple is too small, the high pressure in the conduit upstream of the tool may force the tool completely through the nipple or can cause the tool to otherwise deform or damage the landing surface which, in turn, is likely to result in failure of any operation being carried out with the tool. Unfortunately, the annular landing surface in the nipple must protrude into the conduit and accordingly reduces the inside diameter of the nipple (i.e. the diameter of the bore through the nipple). This reduction in the inside diameter of the nipple adversely affects the ultimate flow capacity through the conduit. Where only one or two no-go nipples are incorporated into a "tapered" or "staggered" conduit string, this restriction in flow capacity is such that it may be tolerated in some cases.

However, there are often instances where it is desirable to use several no-go nipples in a single conduit string. For example, landing nipples may be spaced along the length of a well conduit so that different lengths of that conduit can be individually tested in order to locate the approximate depth at which a leak occurs. When a plurality of no-go landing nipples are used in a conduit string, the restriction of flow through the conduit is further amplified by the fact that the bore (i.e. inside diameter of each nipple) must be progressively smaller than that of the nipple immediately above it.

This decrease in inside diameter (i.e. decrease in flow capacity) is necessary in order for each well tool to reach its respective, designated landing surface. That is, the outer diameter of the well tool to be landed in the lowermost nipple must be small enough to allow it to pass through the bores of all of the upper landing nipples before coming to rest in the lowermost nipple. The diameter of the tool to be landed in the nipple immediately above the lowermost nipple must be small enough to allow it to pass through the bores of all of the nipples above that in which the tool is to be landed, etc.

Remembering that the landing surface area of all no-go nipples, even the uppermost or largest-bored nipple, must be relatively large in order to provide the necessary support for a well tool during a well operation, the use of more than one no-go nipple may result in inherently restricting the flow capacity of the conduit to an unacceptable level. Accordingly, the practical number of no-go nipples which can be used in a tapered well conduit and still maintain an acceptable flow capacity through the conduit is normally limited to a very small number, if any more than one.

There are types of landing nipples other than no-go nipples available for use in well conduits(e.g. a uniform or standard-size nipple) each having the same-sized, landing surface therein. A plurality of these uniform nipples can be incorporated into a well conduit without progressively restricting the flow through the conduit as would be the case when using the same number of no-go nipples. That is, since each landing nipple has basically the same inside diameter or landing surface therein, the reduction of flow capacity of the conduit is not decreased regardless of the number of nipples in the conduit in excess of one.

When a plurality of uniform nipples are used in a well conduit, a uniform, standard-sized well tool is used which is capable of being "landed" in any one of the uniform nipples in the conduit. The tool is lowered into the conduit on a wireline and is constructed so that it will pass through any or all of the nipples as the tool moves downward in the conduit. Typically, such a tool will include outwardly-biased dogs or the like which are cammed inwardly as the tool passes through a nipple.

After the tool has passed completely through the designated nipple in which the tool is to be landed, the direction of the tool is reversed by pulling upward on the wireline. The outwardly-biased dogs on the tool now positively engage a shoulder or surface in the nipple whereby further upward movement will actuate a locking mechanism in the tool to lock the tool within the nipple. In its locked position, substantially all of any upward and/or downward forces applied on the tool during a well operation will be transferred to the nipple through the locking mechanism.

When it is desired to remove the uniform well tool, the tool is further manipulated by raising and/or lowering the wireline to unlock the tool from the nipple and lift it from the well. While this type of uniform nipple substantially reduces the flow restriction problems presented by the use of a plurality of no-go nipples in a conduit, it can easily be seen it requires the use of a much more sophisticated and complex well tool which, in turn, substantially increases both the cost of the tool and the problems in handling and manipulating the tool during the placement and removal of the tool.

SUMMARY OF THE INVENTION

The present invention provides a well tool system and a method utilizing said system (e.g. pressuring a well conduit) to determine whether the conduit has leaks. The present well conduit system allows a plurality of no-go type landing nipples to be used in a staggered or tapered conduit string without prohibitively restricting the flow therethrough. The inside diameter or bore of each successive present nipple will still progressively decrease towards the lowermost nipple similarly as in the prior art no-go nipples. However, due to the construction of the present well tool, this decrease in the diameter of the bore will be substantially less than was required in known prior no-go nipples.

This is due to the fact that the landing surfaces in the respective no-go nipples of the present system do not provide the main support for a well tool during a well operation and accordingly do not have to withstand any substantial downward force on the tool as required in the prior art nipples. Therefore, the present invention allows a greater number of no-go nipples to be used in a tapered string of conduit before the flow capacity of the conduit is reduced to an unacceptable level.

Basically, the present invention uses a no-go landing nipple which has a relatively small landing surface (hence a larger bore or flow passage therethrough) when compared to previous no-go nipples. The landing surface in each nipple is designed to be only large enough to support slightly more than the weight of the well tool landed thereon. The present invention provides a well tool which makes the use of such small landing surfaces possible.

More specifically, the well tool of the present invention is comprised of a body having a bore therethrough. An expander is fixed to the body and has passages therethrough which fluidly communicate with the bore in the body to form a flow passage through the tool. A valve element is slidably positioned in the tool to block flow through the tool when the valve element is in a closed position. A fishing neck or the like is attached to the upper end of the valve element and is adapted to be connected to a wireline on which the tool can be lowered and raised in the well conduit.

One or more load-bearing keys are retained on the tool by a retainer sleeve and are expandable from a retracted position (i.e. position while the tool is being lowered or raised in the conduit) to an expanded position (i.e. position when the tool is set in the nipple). The retainer sleeve is slidably mounted on the expander but is originally secured against movement by an actuable release (e.g. a shear pin, a spring , etc.). A seal or packing means is provided on the body for providing a flow-blocking seal between tool and conduit whenever the tool is in an operable position within its respective landing nipple. A shoulder is provided on the retainer which is adapted to engage and initially support the tool on the landing surface of a designated nipple when the tool reaches its destination.

While the present invention can be used in carrying out a variety of well operations (e.g. setting packers, protecting lower zones when circulating above perforations or through sliding sleeve valves, etc.) it is especially useful in pressuring a conduit string to test for leaks. A tapered string of well conduit (e.g. production tubing) is made up with a present no-go nipple being positioned at each point along the conduit at which the conduit may be subsequently tested for leaks. The conduit string is then positioned in the well.

When it is desired to carry out the operation, the first well tool to be lowered will normally be the one which has the smallest outer diameter (i.e. shoulder) of any of the tools to be used during the operation. This allows the tool to pass through all of larger bores of the upper nipples and into the lowermost nipple in the conduit string. The tool will be stopped by and will be initially supported on the relatively small landing surface in the lowermost nipple.

The load-bearing keys will remain in a retracted position as the tool moves downward in the conduit until the tool reaches the lowermost nipple. As the tool comes to rest on the small landing surface within the nipple, the wireline is relaxed, which allows the valve element to close and block flow through the tool. A downward force is then applied on the tool. That is, the tool is jarred or the pressure above the tool is slightly increased to actuate the release and thereby allow the expander to move downwardly with respect to the retainer sleeve. Continued downward movement of the retainer sleeve relative to the expander moves the load-bearing keys outwardly into load-bearing grooves provided in the nipple and releasably latches the keys in their expanded position.

Pressure in the conduit above the tool is then increased further to a relatively high test pressure. Substantially all of the downward force on the tool is now transmitted to the nipple through the expanded and latched load-bearing keys with little force being applied to the relatively small landing surface in the nipple. Accordingly, there is little risk of damaging either the landing surface in the nipple or the tool during the landing or setting of the tool or during the test operation.

The conduit is shut in and the test pressure is monitored to determine if there are any leaks in the conduit above the tool. If a leak is detected, it may be anywhere along the length of tubing above the lowermost nipple. Accordingly, it may be desirable to more accurately locate the leak by removing the tool and lowering a larger-diameter well tool onto one of the nipples located above the lowermost nipple and repeat the test until the length of conduit having the leak is identified.

The present well tool can easily be removed from its nipple with a minimum of manipulation. This is done by merely releasing the pressure above the tool and pulling upward on an attached wireline. As the valve element moves upward to reopen flow through the tool, the lower end thereof engages the expander to move it upward, thereby unlatching the keys from the nipple and releasing the tool for removal.

BRIEF DESCRIPTION OF THE DRAWINGS

The actual construction, operation, and apparent advantages of the present invention will be better understood by referring to the drawings in which like numerals identify like parts and in which.

DESCRIPTION OF THE PREFERRED EMBODIMENTS

The use of landing nipples to land or position well tools at designated locations in a well conduit is well known. One type of such nipples is commonly referred to as a "no-go" nipple. A typical no-go nipple has an annular landing surface which is adapted to engage and stop a particular well tool as that tool is lowered in the conduit. The landing surface in a typical no-go nipple provides substantially all of the support necessary to land, set, and resist the downward forces on the tool during any subsequent well operation.

To provide this necessary support for the tool, especially when high downward forces are to be applied against the tool, the area of the landing surface must be relatively large in order to prevent the tool from damaging or deforming the landing surface, which results in failure of any well operation to be carried out with the tool. Further, where a plurality of no-go nipples are incorporated into a well conduit, the inside diameter of each nipple (i.e. the diameter of the bore through the nipple) must be smaller than that of the nipple immediately above in order for a particular well tool to pass through those nipples which may lie above the nipple in which the tool is to be landed.

Figure 1:
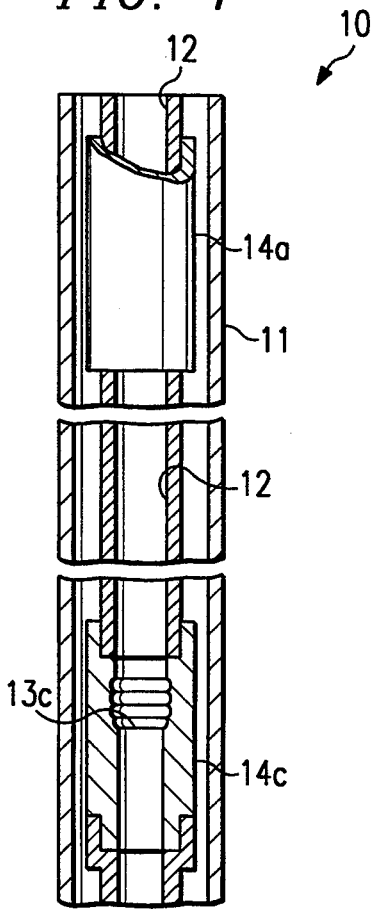
FIG. 1 is an elevational view, partly in section, of the lower portion of a typical wellbore in which the present well system is used.
Figure 3:
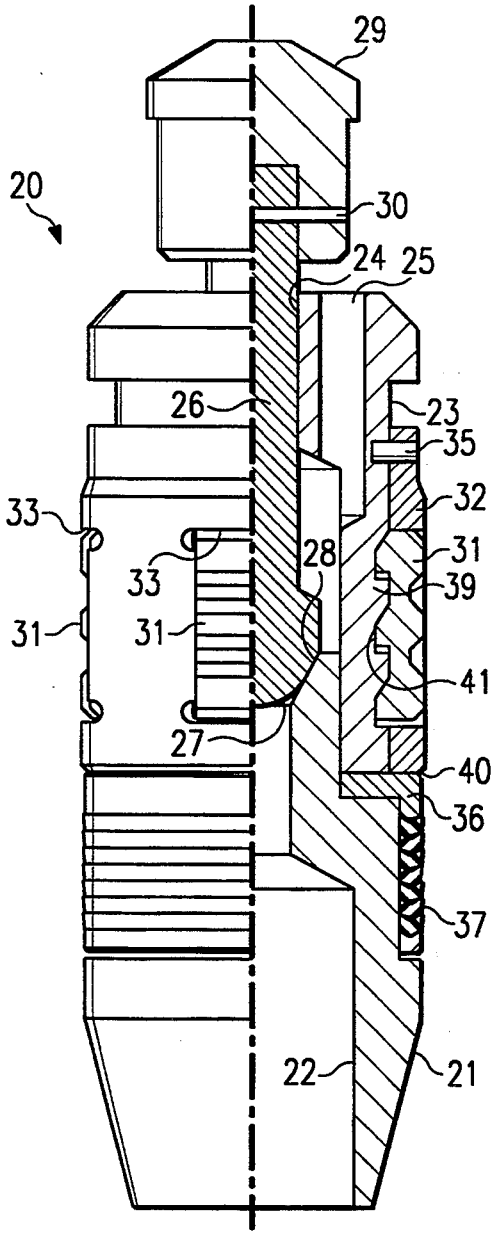
FIG. 3 is an elevational view, partly in section, of one embodiment of the well tool of the present invention.
Figure 2:
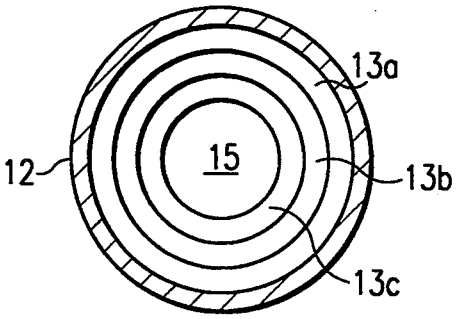
FIG. 2 is a top view looking down a well conduit ideally illustrating respective inside diameters and landing surfaces of a plurality of prior art no-go landing nipples which are spaced along a length of well conduit, the inside diameters and landing surfaces being exaggerated for clarity.

To better understand the inherently progressively-smaller inside diameters of successive no-go landing nipples in a well conduit, reference is made to FIG. 2, which represents an idealized view when looking down a well conduit having a plurality of prior art no-go landing nipples therein. It can be seen that the inside diameter or bore of each landing surface 13*a*, 13*b*, and 13*c* is progressive smaller beginning with the uppermost nipple ( e.g. see nipple 14*a* in FIG. 1) and moving downward to lowermost (e.g. see nipple 14*c* in FIG. 1; nipple 14*b* is not shown in FIG. 1). Since each of the landing areas must be relatively large in order to support a tool, it can readily be seen that if many more than one typical, prior art, no-go nipple are used in a single string of conduit, the ultimate flow capacity (i.e. smallest bore 15 in FIG. 2) of the conduit quickly approaches an unacceptable level.

In accordance with the present invention, a well tool is provided which allows a plurality of no-go type landing nipples to be used in a staggered or tapered conduit string without prohibitively restricting the flow therethrough. That is, (a) the landing surface area of each no-go landing nipple is still sized to engage and initially support a particular well tool as the tool is lowered in the conduit and (b) the inside diameters of successive nipples will still progressively decrease towards the lowermost nipple similarly as in a tapered string using prior art no-go nipples, but, due to the construction of the present well tool, these landing surfaces will be substantially smaller than those in previous no-go nipples. This is due to the fact that the landing surface in the present invention does not provide the main support for the tool as previously required in prior art no-go nipples. Accordingly, a greater number of no-go nipples can be used in a tapered string of conduit before a minimum acceptable flow capacity in the conduit is reached.

Referring now more particularly to the remaining drawings, FIG. 1 illustrates the lower end of a typical wellbore 10 in which the present invention is to be utilized. As will be understood by those skilled in the art, well 10 is cased with casing 11 and has a string of well conduit (e.g. production tubing 12) positioned therein. While the present invention will be described herein in conjunction with a string of production tubing, it should be understood that it can also be used with other well conduits strings (e.g. casing, drill pipe, etc.) where landing nipples may be used to land downhole well tools.

Figure 5:
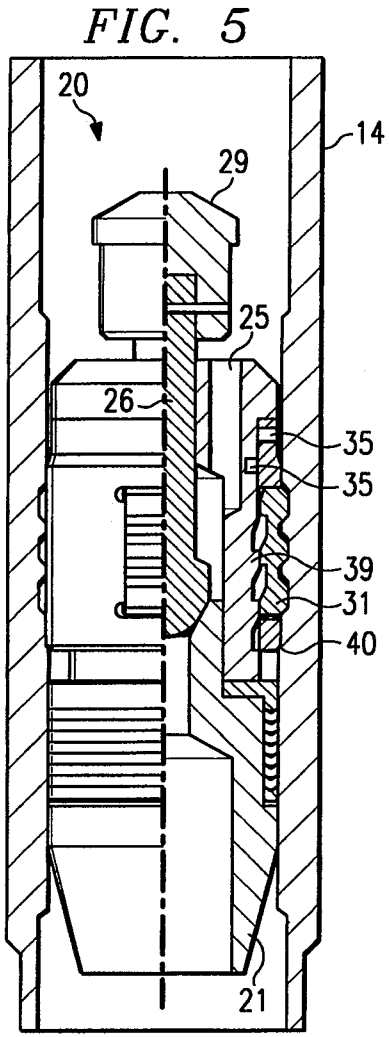
FIG. 5 is an elevational view, partly in section, of the well tool of FIG. 4 with the tool in an operable position within the nipple.
Figure 4:
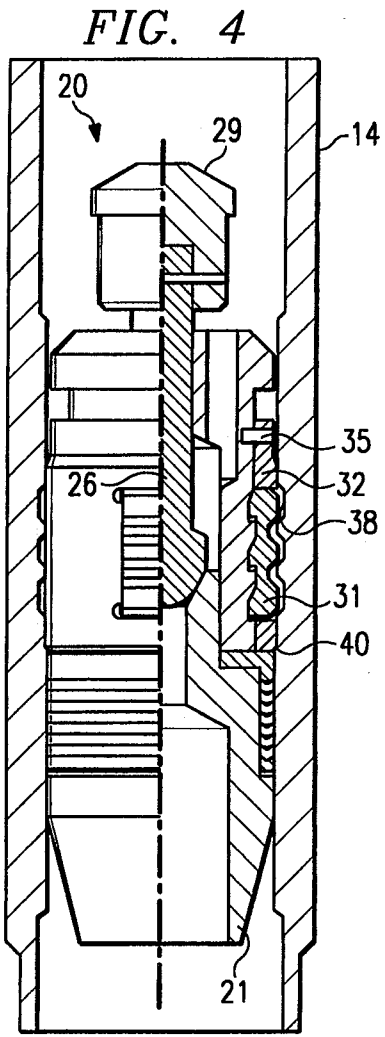
FIG. 4 is an elevational view, partly in section, of the well tool of FIG. 3 as the tool is lowered into engagement with a landing surface of a no-go landing nipple of the present invention

As tubing string 12 is being made up and run into the wellbore, a landing surface is provided at each location where a well tool may be subsequently landed. For example, if tubing string 12 is to be tested for leaks at different depths, then a no-go landing nipple would be positioned within the tubing string 12 at each depth where a test operation may be ultimately performed. As illustrated, each landing surface is actually formed by an annular shoulder 13 within a respective, no-go landing nipple 14 (see FIGS. 4–6). Each landing surface 13 is sized and adapted to engage a respectively-sized shoulder (further described below) on a well tool to stop and initially support the tool as it is lowered through tubing 12. This landing surface is small when compared to the equivalent surface of a prior art no-go landing nipple and needs to be only big enough to initially support a weight slightly greater than that of the tool itself.

Referring now to FIGS. 3 and 4–7, a first embodiment of a well tool 20 in accordance with the present invention is disclosed. Tool 20 is comprised of a body 21 having an axial bore 22 therethrough. Expander ring 23 is threaded or otherwise secured to body 21 and has an axially-aligned bore 24 and offset longitudinally-extending passages 25 (only one shown), the latter being in fluid communication with bore 22 of body 21 to form a flow passage through tool 20. Slidably positioned within axial bore 24 of expander ring 23 is valve element 26 having a sealing surface 27 at its lower end which cooperates with seat 28 at the upper end of bore 22 to block flow through the tool 20 when valve element 26 is in a closed position. A fishing neck 29 or the like is attached to the upper end of valve element 26 by any suitable means (e.g. threads and set screw or roll pin 30) and is adapted to be releasably connected to a wireline (not shown).

Figure 6:
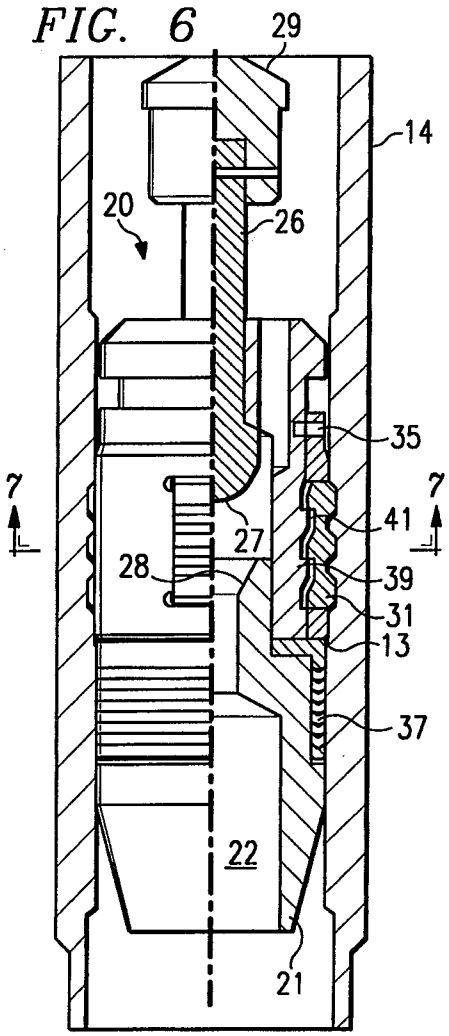
FIG. 6 is an elevational view, partly in section, of the well tool of FIG. 4 as the tool is being removed from the nipple.
Figure 7:
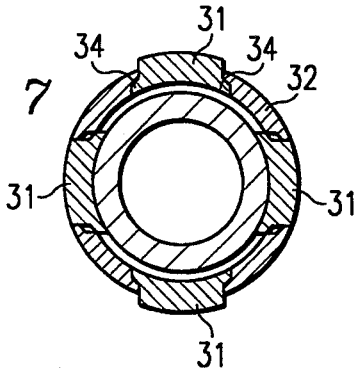
FIG. 7 is a sectional view taken along line 7—7 of FIG. 6, showing two of the load-bearing keys in a retracted position and two keys in an expanded position.

One or more load-bearing keys 31 are spaced about the periphery of expander ring 23 (four shown radially spaced at 90 ° intervals, see FIG. 7) and are retained on expander ring 23 by retainer sleeve 32. Each key 31 is expandable from a retracted position (FIGS. 3 and 4) to an expanded position (FIGS. 5–6) through respective windows 33 in sleeve 32 as will be explained in further detail below. As seen in FIG. 7, each key 31 has lugs 34 or the like thereon which prevents a key from passing completely outward through its respective window.

Retainer sleeve 32 is slidably mounted on expander 23 and is originally secured against movement thereon by an actuable release, i.e. shear pin 35 (FIGS. 3 and 4), a biased detent (not shown), a spring (FIGS. 8–9); the latter to be further discussed below, or any other like means. Spacer 36 and a seal means 37 (e.g. chevron packing or the like) are provided on the body 21 below expander 23 for providing a flow-blocking seal between tool 20 and tubing 12 when said tool is in an operable position within its respective landing nipple.

Retainer sleeve 32 is sized so that the lower surface (FIG. 3) of its outer periphery will provide a shoulder 40 which, in turn, is adapted to engage and initially support the tool on the landing surface 13 of a respective or designated nipple 14. That is, shoulder 40 on a particular well tool 20 is small enough to pass through all of the no-go nipples (e.g. **14*a* in FIG. 1) in tubing 12 above a designated landing nipple (e.g. 14*c*) in which the particular well tool is to be landed. With the construction of the tool 20** having been described above, the operation of the tool will now be set forth.

While the present invention can be used in carrying out a variety of well operations where flow is to be blocked in a well conduit (e.g. setting packers, protecting lower zones when circulating above perforations or through sliding sleeve valves, etc.), it is especially useful in testing a conduit string for leaks. In such an operation, a plurality of no-go nipples 14 are made up into a tapered tubing string 12 as the tubing is lowered into the well. The no-go nipples 14 have relatively small landing surface areas as explained above and will be spaced along the conduit so that different lengths of the conduit may be tested sequentially when desired.

In a typical test operation, a well tool 20 having the smallest diameter shoulder 40 is first lowered on a wireline (not shown) through the upper nipples (e.g. **14*a*) and into the lowermost nipple (e.g. 14*c*) where it is engaged and initially supported on the landing surface 13*c* of nipple 14*c*. Load-bearing keys 31, which are loosely supported within retainer sleeve 32, will remain in a substantially retracted position (FIGS. 3 and 4) as tool 20 moves downward in tubing 12. If one or more of keys 31 should accidentally engage any of the load-bearing grooves 38** in any of the upper nipples before the tool reaches its lowermost nipple, the keys will merely cam inwardly upon the continued downward movement of the tool and will not impede the lowering of the tool to its designated nipple.

When tool 20 reaches the lowermost nipple, shoulder 40 on the tool will engage landing surface 13 in the lowermost nipple which brings the tool to rest. Relaxation of the wireline (not shown) allows valve element 26 under its own weight to move downward to close the passage 22, 25 through the tool thereby blocking downward flow through the conduit at that point. The release (e.g. shear pin 35) is actuated by applying a downward force on the tool. This force may be applied by jarring the tool or by slightly increasing the pressure in the conduit above the tool (e.g. 400 psi) to shear pin 35, which then allows the expander ring 23 to move downwardly with respect to the retainer sleeve 32 which, in turn, is held against movement by shoulder 40 on landing surface 13. It is noted that the shear pin is designed to shear under a relatively small increase in pressure so that no substantial downward force will need to be applied to landing surface 13 during the shearing of the pin.

Continued downward movement of retainer sleeve 32 causes the internal ridges 39 thereon to move behind the raised portions 41 integrally formed on the rear of keys 31 to thereby force the keys outwardly into grooves 38 of the nipple and hold them in the grooves until released. Also, the engagement between the keys and their respective grooves will cause the shoulder 40 to move upward slightly thereby further reducing the force being exerted upon landing surface 13. Pressure in the conduit above the tool is then increased to a relatively high test pressure. Substantially all of the downward forces due to this increased pressure is now transmitted to the nipple through the expanded, load-bearing keys 31 with little force, if any, being applied to the relatively small landing surface 13.

The tubing is then shut in and the test pressure is monitored for a desired period to determine if there are any leaks in the tubing above tool 20. Any leak detected may be anywhere along the length of tubing above the lowermost nipple. Accordingly, it may be desirable to more accurately locate the position of the leak by removing the tool and lowering a larger-diameter well tool 20 onto an upper nipple in the conduit at which point the test is repeated. This test operation can be repeated at each or any nipple in the conduit until the approximate depth of the leak is determined.

Well tool 20 can easily be removed with a minimum of manipulation by merely releasing the pressure above the tool and pulling upward on an attached wireline (not shown). As valve element 26 is moved upward to reopen flow through the tool, the lower end thereof engages the lower end of bore 24 in expander ring 23 to move expander 23 and its integral ridges 39 upward out of engagement with the raised portions 41 of keys 31 (FIG. 6). All of the keys 31 are now free to be cammed inwardly as the wireline moves the tool 20 upwardly out of the conduit.

Figure 8:
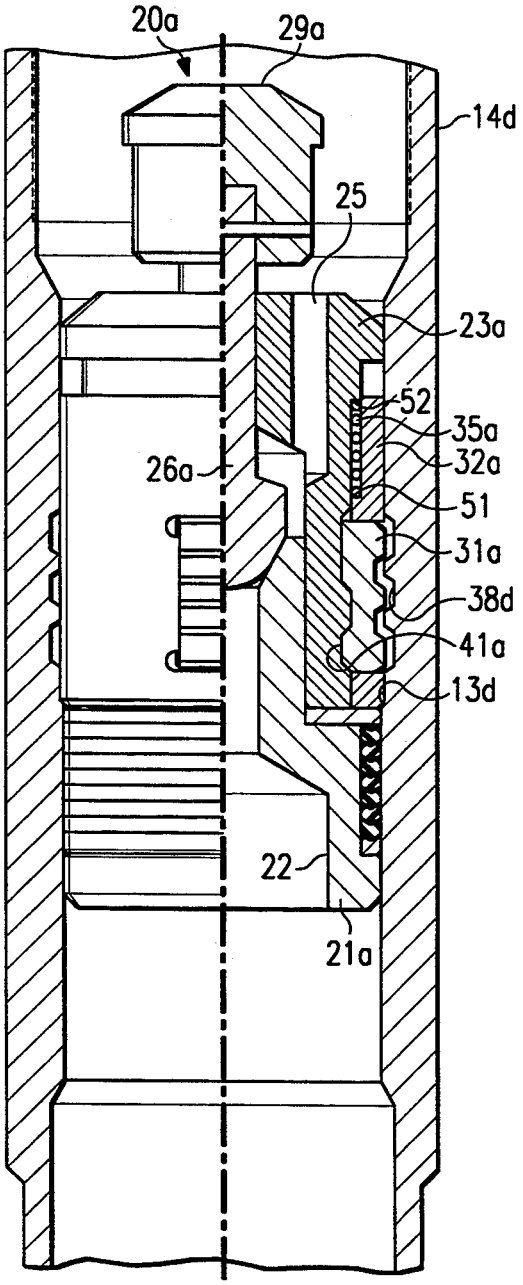
FIG. 8 is an elevational view, partly in section, of another embodiment of the present well tool with the load-bearing keys in a retracted position.
Figure 9:
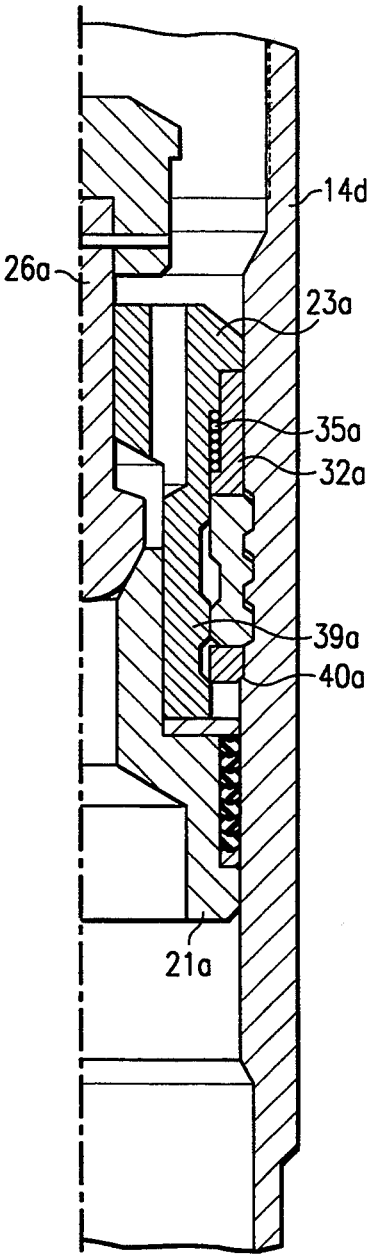
FIG. 9 is a half sectional view of the tool of FIG. 8 with the load-bearing keys in an expanded position.

Another modification of the present well tool is shown in FIGS. 8 and 9. Basically, tool **20*a* is the same as described above except the actuable release for originally preventing movement between retainer sleeve 32*a* and expander 23*a* is not a shear pin but instead is comprised of a spring 35*a*. Spring 35*a* is positioned between shoulder 51 on sleeve 32*a* and shoulder 52 on expander 23*a* to normally bias sleeve 32*a* away from expander 23*a* as the tool is lowered into its designated nipple 14*d***.

In this position (FIG. 8), load-bearing keys **31*a* are in their retracted position. As tool 20*a* reaches nipple 14*d*, shoulder 40*a* on the tool engages landing surface 13*d* in the nipple, which stops and initially supports the tool in the nipple. Relaxation of the wireline (not shown) allows valve element 26*a* to close flow through the tool. Pressure is then slightly increased to move expander 23*a* downward against the bias of spring 35*a* to move ridges 39*a* on the expander behind the raised portions 41*a* on the respective load-bearing keys 31*a* to expand and releasably latch the keys in grooves 38*d* of the nipple (FIG. 9). Once the keys are expanded and latched, substantially all of the downward forces subsequently applied on tool 20*a* will be transmitted through the keys to the nipple with little, if any, of the forces being applied against the relatively small landing surface 13** of the nipple.

To release tool 20*a*, the upstream pressure is reduced and the wireline is raised which allows spring 35*a* to return expander 23*a* to its original position where the keys 31*a* are free to cam inwardly as the tool is removed from the conduit.

What is claimed is:

1. A well test tool for pressuring a tubular conduit comprising:

a body;

a shoulder located upon said body for contacting an opposing and engageable surface of a nipple, the nipple being within a tubular conduit in which the tool is to be positioned, wherein the diameter of said shoulder is larger than the diameter of said nipple surface whereby the passage of the tool past the nipple surface is impeded; and at least one outwardly extendable, load-bearing key mounted upon said body, said key constructed for engagement with the nipple in the conduit and such that said engagement restricts relative motion between the tool and the conduit only in the direction of said shoulder and wherein said at least one key is constructed so that upon said key's engagement with the nipple surface, additional movement of the tool toward the shoulder is prevented, thereby restricting additional force from being transferred to the nipple surface.

2. The well tool of claim 1 wherein said at least one key is constructed so that upon said engagement of said key with the nipple, the tool is moved away from the nipple surface by said engagement, thereby reducing the force being exerted upon the nipple surface by the tool.

3. A well conduit system comprising:

a length of conduit positioned within a well;

a landing surface within said conduit;

a well tool adapted to be lowered from the surface onto said landing surface within said conduit; said well tool comprising:

a body having an external landing shoulder adapted to engage said landing surface within said conduit when said tool is in an operable position;

at least one expandable, load-bearing key carried by said body; by said body; said key constructed for engagement with the nipple in the conduit whereby said engagement will restrict relative motion between the tool and the conduit only in the direction of said shoulder and wherein said at least one key is constructed so that upon said key's engagement with the nipple surface, additional movement of the tool toward the shoulder is prevented, thereby restricting additional force from being transferred to the nipple surface; and means for expanding said load-bearing key into engagement with said conduit after said shoulder of said tool is in engagement with said landing surface in said nipple whereby substantially all downward force on the tool will be transferred through said load-bearing key to said conduit.

4. The well conduit system of claim 3 wherein said well tool includes:

a flow passage through said body; and a valve element positioned within said body and moveable between an open position wherein flow is permitted through said flow passage as said body is moved through the conduit and a closed position to prevent flow through said conduit when said tool is landed on said landing surface.

5. The well conduit system of claim 4 wherein said body of said well tool comprises:

an expander; and a retainer slidably mounted on said expander and positioned to retain said at least one expandable loadbearing key on said expander.

6. The well conduit system of claim 4 including:

an actuable release securing said load-bearing key in a retracted position on said body during lowering of said tool in said conduit, said release preventing relative movement between said expander and said retainer until said release is actuated by landing said shoulder of said tool on said landing surface in said conduit.

7. The well conduit system of claim 6 wherein said actuable release comprises a shear pin.

8. The well conduit system of claim 6 wherein said actuable release comprises a spring positioned to normally bias said expander away from said retainer.

9. The well conduit system of claim 3, herein the means for expanding said at least one loading-bearing key of said well tool comprises:

raised surfaces on said expander and said key, respectively, which engage each other as said retainer moves with respect to said expander and said key to move said key outwardly with respect to said body.

10. The well conduit system of claim 3 wherein said well tool includes:

packing on said body for providing a seal between said tool and said conduit when said tool is in an operable position within said conduit.

11. The well conduit system of claim 3 including:

a load-bearing groove in said conduit above said landing surface adapted to receive said load-bearing key when said key is in an expanded position.

12. The well conduit system of claim 3 including:

a plurality of landing surfaces spaced along said length of conduit, each having an inside diameter progressively smaller than that of the landing surface next above.

13. A method for pressuring a length of conduit in a well comprising:

providing a landing nipple at the lower end of said length of conduit to be tested, said nipple having a landing surface thereon;

landing a well tool on said landing surface to block flow through said conduit; and increasing the pressure in said conduit above said tool to expand at least one load-bearing key carried by said tool into engagement with said nipple whereby substantially all downward force on said tool will be transferred through said at least one load-bearing key to said nipple.

14. The method of claim 13 including:

further increasing the pressure in said conduit above the well tool to a predetermined test pressure; and monitoring said increased pressure in said conduit over a prescribed period.

15. A well tool comprising:

a body comprising:

an expander; and a retainer slidably mounted on said expander and having an external landing shoulder adapted to engage a landing surface within a no-go landing nipple when said tool is lowered into the nipple;

at least one expandable, load-bearing key carried by said retainer, said key constructed for engagement with a surface in the nipple whereby said engagement will restrict relative motion between the tool and the nipple only in the direction of said shoulder and wherein said at least one key is constructed so that upon said key's engagement with the nipple surface, additional movement of the tool toward the shoulder is prevented, thereby restricting additional force from being transferred to the nipple surface; and means for expanding said at least one load-bearing key outward from said landing shoulder upon upward movement of said expander in relation to said retainer for engaging said landing surface within the nipple, whereby substantially all downward force on said tool will be transferred through said at least one load-bearing key to said nipple.

16. The well tool of claim 15 including:

a flow passage through said body; and a valve element positioned within said body and moveable between an open position wherein flow is permitted through said flow passage and a closed position to prevent flow through said conduit.

17. The well tool of claim 15 including:

an actuable release securing said load-bearing key in a retracted position on said body during lowering of said tool in said conduit, said release preventing relative movement between said expander and said retainer until said release in actuated by landing said shoulder of said tool onto said landing surface in said nipple.

18. The well tool of claim 17 wherein said actuable release comprises:

a shear pin between said retainer and said expander.

19. The well tool of claim 17 wherein said actuable release comprises:

a spring positioned to normally bias said expander away from said retainer.

20. The well tool of claim 15 wherein the means for expanding said at least one loading-bearing key of said well tool comprises:

raised surfaces on said expander and said key, respectively, which engage each other as said retainer moves with respect to said expander and said key to move said key outwardly with respect to said body.

21. The well tool of claim 15 wherein said at least one load-bearing key comprises:

four load-bearing keys spaced at 90° intervals around said expander.

22. The well tool of claim 15 including:

packing on said body for providing a seal around said tool when said tool is in an operable position within a well.

23. The well tool of claim 15 wherein said at least one key is constructed so that upon said engagement of said key with the landing surface, said tool is moved away from said landing surface by said engagement, thereby reducing the downward force being exerted upon said landing surface by the tool.

* * * * *